US011896071B2

(12) United States Patent
Merrill et al.

(10) Patent No.: US 11,896,071 B2
(45) Date of Patent: Feb. 13, 2024

(54) GARMENT FASTENING SYSTEMS, DEVICES AND METHODS

(71) Applicant: Lunya Company, Santa Monica, CA (US)

(72) Inventors: Ashley Merrill, Santa Monica, CA (US); Alisha Lipman, Encino, CA (US); Kathryn Kirby, Venice, CA (US)

( * ) Notice: Subject to any disclaimer, the term of this patent is extended or adjusted under 35 U.S.C. 154(b) by 844 days.

(21) Appl. No.: 16/658,086

(22) Filed: Oct. 19, 2019

(65) Prior Publication Data

US 2020/0178628 A1 Jun. 11, 2020

Related U.S. Application Data

(60) Provisional application No. 62/748,267, filed on Oct. 19, 2018.

(51) Int. Cl.
*A41D 31/18* (2019.01)
*A45D 8/34* (2006.01)

(52) U.S. Cl.
CPC ..... *A41D 31/18* (2019.02); *A45D 8/34* (2013.01); *A41D 2300/332* (2013.01); *A41D 2400/82* (2013.01); *A41D 2500/10* (2013.01)

(58) Field of Classification Search
CPC ..... A41B 9/001; A41B 9/002; A41B 9/008; A41B 9/02; A41B 9/04; A41B 9/14; A41B 11/126; A41D 1/06; A41D 2400/80; A41D 2400/82; A41D 2300/332; A41F 9/00; A41F 9/02; A41F 9/002
See application file for complete search history.

(56) References Cited

U.S. PATENT DOCUMENTS

2002/0071939 A1* 6/2002 Tomiyasu ..... A41F 9/00 442/190
2010/0132093 A1* 6/2010 Ogawa ..... A41F 9/00 428/169
2016/0157529 A1* 6/2016 Hoeven ..... A41B 17/00 2/337
2017/0013888 A1* 1/2017 Webb ..... A41D 13/0015
2019/0350269 A1* 11/2019 DeSimone ..... A41B 7/00

* cited by examiner

*Primary Examiner* — Katherine M Moran
(74) *Attorney, Agent, or Firm* — Beckman Law P.C.; Christopher V. Beckman

(57) ABSTRACT

New garment-fastening techniques are provided. In some embodiments, a new form of adjustable hair tie is provided. In some such embodiments, a new form of scrunchie is provided. In some embodiments, the new form of scrunchie includes widely-variable, user-adjustable tension, elastic cushioning disposed on or about a contact area with a user's hair, and a smooth (e.g., silk) surface. In some embodiments, the contact area surrounds and defines a central hair-gripping void with a user-variable size, and includes a substantially flattened support and profile. In some embodiments, a new form of waistband, wristband, or other clothing-fastening band of material is provided. In some such embodiments, a new form of garment enhancement device, incorporating a unique pattern of alignment- and grip-enhancing sub-elements, is provided on or about such a band, which improves garment positioning, and provides a non-stick hold on a user's body.

18 Claims, 11 Drawing Sheets

GARMENT FASTENING SYSTEMS, DEVICES AND METHODS

CROSS-REFERENCE TO RELATED APPLICATIONS

This application claims the benefit of priority to U.S. Provisional Application No. 62/748,267, filed Oct. 19, 2018, titled "Garments and Accessories and Their Fabric and Design," the entire contents of which are herein incorporated by reference in their entirety.

FIELD OF THE INVENTION

The present invention relates to the field of fastening devices for garments, accessories, systems and methods. More particularly, the present invention also relates to waistbands, scrunchies, grips and devices, systems and methods for improving the hold of garments and accessories on a user's body.

BACKGROUND

Clothing and other human body adornments have existed since before recorded history. As early humans became more nomadic, walking long distances, they lost body hair to prevent overheating, but the lack of body hair posed new, highly variable threats from the environment. At least 50,000 years ago, prehistoric man began sewing animal hides together to cover their bodies, and provide protection suitable for their varying environments. Humans advanced past the simple repurposing of animal hides, and created felt and other textiles, starting perhaps 10,000 years ago. Textiles allowed humans to adapt to a wider variety of environments, using different thicknesses and types of materials. Textiles also have a much wider range in physical appearance than hides. At the same time, accessories and body ornaments were developed, such as necklaces and earrings, for predominantly aesthetic reasons. Humans began to adorn their bodies, and improve their physical appearance using clothing and jewelry, giving birth to fashion.

In modern fashion, a wide variety of body-supporting garments have been developed, including some devices that aid in fastening or otherwise holding garments to the human body. For example, belts, ties and elastic bands have been developed for holding pants, tops, socks and other garments to a user's body, preventing them from slipping off. As another example, to help manage longer head hair, hair clips, hair ties, barrettes, pins, hair and headbands, scarves and other hair accessories have been developed, which gather hair together or hold it in some fashion. Some such hair tie devices, known as "scrunchies," include an elastic band within a textile, providing a constant active tension. Some such scrunchies may bear an adornment, such as jewelry or a decorative textile.

It should be noted that some of the disclosures set forth as background, such as, but not limited to, the above language under the heading "Background," do not relate exclusively to prior art and the state of the art in the field(s) of the invention, and should not be construed as an admission with respect thereto.

SUMMARY OF THE INVENTION

New garment-fastening techniques are provided. In some embodiments, a new form of adjustable hair tie is provided. In some such embodiments, a new form of scrunchie is provided. In some embodiments, the new form of scrunchie includes widely-variable, user-adjustable tension, elastic cushioning disposed on or about a contact area with a user's hair, and a smooth (e.g., silk) surface. In some embodiments, the contact area surrounds and defines a central hair-gripping void with a user-variable size, and includes a substantially flattened support and profile. In some embodiments, a new form of waistband, wristband, or other clothing-fastening band of material is provided. In some such embodiments, a new form of garment enhancement device, incorporating a unique pattern of alignment- and grip-enhancing sub-elements, is provided on or about such a band, which improves garment positioning, and provides a non-stick hold on a user's body.

Some embodiments of the invention relate to new textiles. In some such embodiments, new fabrics, for use in clothing and other devices, are provided. In some such embodiments, fabrics including cotton are provided. In some embodiments, fabrics including silver are provided. In some embodiments, fabrics including polyester are provided. In some embodiments, fabrics including 37.5 TECHNOLOGY, which are currently available from Cocona, Inc., are provided. In some embodiments, blends of such different fabric materials, and/or other materials, are provided. For example, in some embodiments, a blend including cotton and another material is provided. As another example, in some embodiments, a blend including polyester and another material is provided. In some such embodiments, a blend including cotton and polyester is provided.

In some embodiments, 37.5 technology includes active particles. In some such embodiments, such active particles are made, at least in part, from volcanic sand. In some embodiments, such active particles are made, at least in part, from activated carbon. In some embodiments, such activated carbon is in the form of activated charcoal. In some embodiments, such activated carbon is created from coconut shells. Unique combinations and configurations of such materials, and other materials, are set forth as new fabrics, garments, and other devices, in greater detail below.

These and other aspects and examples of the invention will be made clearer below, in other parts of this application. This Summary, the Abstract, and other parts of the application, are for ease of understanding only, and no part of this application should be read to limit the scope of the invention, whether or not it references matter in any other part.

Figure 1:
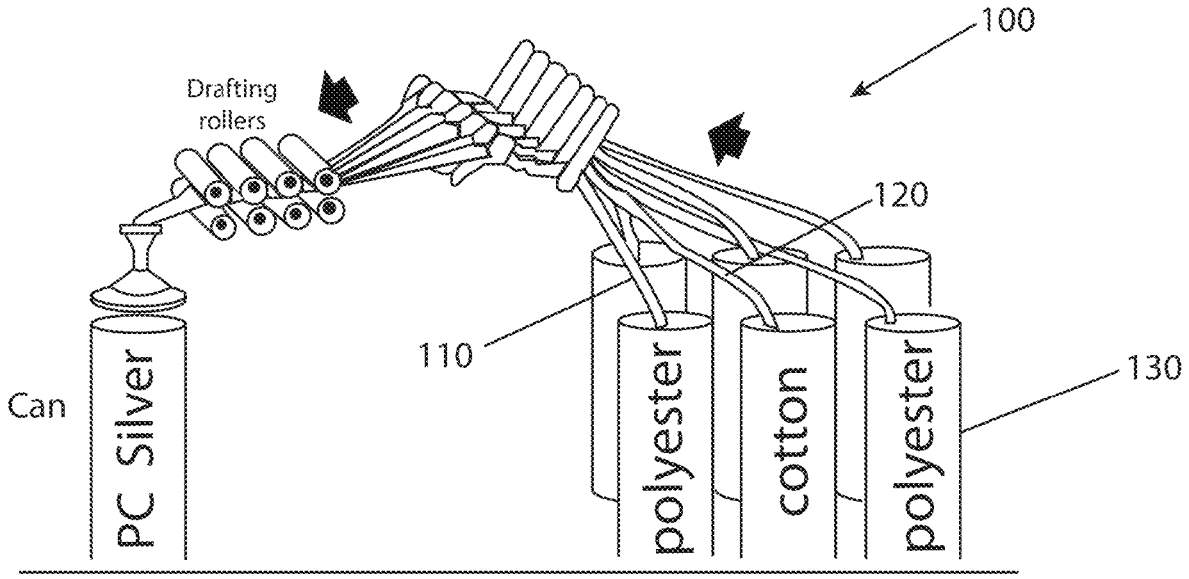
FIG. 1 is a perspective view of an example blending, drawing and spinning system for creating textiles from yarns or other elongated groups of fibers, in accordance with some embodiments of the present invention.

It should be noted that the figures referenced above are examples only of the wide variety of different embodiments falling within the scope of the invention, as will be readily apparent to those skilled in the art. Thus, any particular size(s), shape(s), proportion(s), scale(s), material(s) or number(s) of elements pictured are illustrative and demonstrative, and do not limit the scope of invention, as will be so readily apparent.

DETAILED DESCRIPTION OF THE INVENTION

The example embodiments of the invention presented herein are directed to new body-holding systems, clothing, accessories, devices, methods and other techniques, which are now described herein. This description and the particular embodiments set forth herein are examples of broader principles of the invention, and do not limit the application and scope of the invention presented herein. In fact, after reading the following description, it will be apparent to one skilled in the relevant art(s) how to implement the following example embodiments in a wide variety of alternative embodiments.

The use of a particular gender, number or order of elements or steps should, similarly, not be considered to limit the scope of the invention, and, with respect to each such element or step, the description should be understood to also set forth, separately and in addition, each other possible gender, number, order and configuration of such element(s) and step(s).

As mentioned above, some embodiments of the invention relate to new textiles. In some such embodiments, new fabrics, for use in clothing and other devices, are provided. In some such embodiments, fabrics including cotton are provided. In some such embodiments, such fabrics include a high proportion of cotton (i.e., are "cotton-rich"). In some such embodiments, such fabrics have a yarn with a cotton composition. In some embodiments, such fabrics are soft to the touch, or softened. In some embodiments, fabrics including pima cotton (e.g., U.S. pima cotton) are provided. In some embodiments, fabrics including an antimicrobial component (e.g., an anti-bacterial component) are provided. For example, in some such embodiments, fabrics including silver are provided. For example, in some embodiments, fabrics including silver compositions (such as XT2, which is currently available from Noble Biomaterials, Inc.) are provided. In some such embodiments, such fabrics including silver compositions include a component in a clear state or format (e.g., silver in a clear state or format). In some embodiments, such components otherwise appear transparent, or substantially transparent. In some embodiments, fabric compositions including an anti-microbial component (such as silver), are used to reduce body odor emanating from a user wearing the fabric. In some such embodiments, such an anti-microbial component is an anti-bacterial component. In some such embodiments, such an anti-microbial component is an anti-fungal component. In some embodiments, fabric compositions including an anti-bacterial component (such as silver), are used to reduce the number of washes necessary to clean clothing, and/or to increase the time between washes of such clothing.

In some embodiments, fabrics in accordance with the present invention (e.g., fabrics incorporating cotton) have a yarn composition of a knit construction. For example, in some such embodiments (e.g., fabrics including cotton and a yarn with a knit construction), such fabrics include a yarn with an interlocking single jersey construction. In some embodiments, some such yarns include one or more elastic fibers. For example, in some embodiments, some such yarns include spandex. In some embodiments, users provide or wear fabrics including any of the yarns set forth in the present application (e.g., yarns including cotton, a knit construction, and spandex) to aid in thermoregulation via the yarn fabric. In some such embodiments, users provide or wear such fabrics to facilitate rest, such as sleeping. In some such embodiments, the yarn fabric is provided and/or worn to improve rest and/or sleep quality by thermoregulation of a user's body.

In some embodiments, a fabric according to the present invention includes a yarn with a cotton composition, a silver composition and a 37.5 technology composition. In some such embodiments, the fabric is cotton-rich. In some embodiments, such a cotton composition includes U.S. pima cotton. In some embodiments, the cotton composition includes a 38 mm kind. In some embodiments, such 37.5 technology is housed in polyester fiber. In some embodiments, any suitable kind of cotton known in the art of creating clothing and textiles may be used. In some embodiments, the 37.5 technology, or another fabric material, includes "active particles," which absorb radiation. In some such embodiments, such active particles absorb infrared radiation. In some such embodiments, such active particles absorb infrared radiation with a range of wavelengths at least partially overlapping with the radiation emission spectrum of the human body. In some embodiments, such active particles include active particles from volcanic sand. In some embodiments, such active particles include active particles made from coconut shells. In some embodiments, such active particles from volcanic sand may have a plurality of pores. In some embodiments, such particles from coconut shells may have a plurality of pores. In some embodiments, such a pluralities of pores may include micropores. In some embodiments, such micropores may number in the billions. In some such embodiments, such micropores may number in the billions within a particular piece of fabric and/or garment.

In some embodiments, such active particles retain more heat in the absence of moisture (e.g., sweat vapor), and serve to heat a user's body when she or he is not sweating (i.e., likely having a cold body temperature). In some embodiments, such active particles lose heat more rapidly in the presence of moisture (e.g., sweat vapor), and serve to cool a user's body when she or he is sweating (i.e., likely having a warm body temperature.) In some embodiments, such cooling is facilitated by the active particles transporting moisture, or accelerating the transportation of moisture, away from a user's body. In some embodiments, such moisture transportation prevents the pooling of sweat about a user's body, increasing comfort and maintaining thermoregulatory control. In some embodiments, the active particles open up (e.g., widen their pores or other openings) when subjected to infrared radiation, creating a cooling effect.

In some embodiments, the 37.5 technology is of a 1.4 dtex×38 mm staple fiber kind. In some embodiments, such a silver composition is XT2. In some embodiments, such XT2 is in a clear state or format. In some embodiments, such XT2 is of a 40/24 DTY yarn kind. In some such embodiments, such XT2 is of a clear yarn kind. In some embodiments, XT2 is used to inhibit the growth of bacteria on garments. In some embodiments, XT2 is used to inhibit the growth of fungi on garments. In some embodiments, XT2 is used to inhibit the growth of bacteria and fungi on garments. In some embodiments, XT2 is used to inhibit the growth of bacteria and fungi on garments and reduce garment odor.

In some embodiments, a cotton-rich fabric is a blended cotton-rich fabric, and combines cotton and 37.5 technology in a single fabric through the use of yarn blending using a draw-frame blending. In some embodiments, a cotton-rich fabric combines cotton and 37.5 technology in a single fabric through the use of yarn sequencing using a draw-frame blending. In some embodiments, a cotton-rich fabric combines cotton and 37.5 technology in a single fabric through the use of yarn blending and yarn sequencing using a draw-frame blending. In some embodiments, any of such fabrics is cotton for customs purposes. In some embodiments, any of such fabrics is cotton to enhance comfort. In some embodiments, any of such fabrics is cotton to enhance aesthetics and user adoption. In some embodiments, any of such fabrics is cotton to enhance the feel of a garment and enhance user adoption. In some embodiments, the blended cotton-rich fabric is created by knitting XT2 in parallel with a 60/1 cotton yarn blended with 37.5 technology.

In some embodiments, any of the cotton-rich fabrics set forth in this application is/are used for garments benefiting from the properties of a fabric of their nature. For example, in some embodiments, any of the cotton-rich fabrics set forth in this application is/are used to create the thermoregulation properties thereof, in some embodiments. As another example, any of the cotton-rich fabrics set forth in this application is/are used to create the humidity control properties thereof, in some embodiments. As another example, any of the cotton-rich fabrics set forth in this application is/are used to create the anti-bacterial properties thereof, in some embodiments. As another example, any of the cotton-rich fabrics set forth in this application is/are used to create the anti-odor properties thereof, in some embodiments. As yet another example, any of the cotton-rich fabrics set forth in this application is/are used to create the thermoregulation, humidity control and anti-bacterial properties thereof, in some embodiments. In some embodiments of cotton-rich fabrics as set forth in the present application, the 37.5 technology preferably makes up at least, or about at least, thirty percent (30%) of the fabric. In some such embodiments, that proportion of 37.5 technology enhances thermoregulation. In some embodiments of other fabrics as set forth in the present application, the 37.5 technology preferably makes up at least, or about at least, thirty percent (30%) of the fabric. In some such embodiments, that proportion of 37.5 technology enhances thermoregulation.

FIG. 1 is a perspective view of an example blending, drawing and spinning system 100 for creating textiles from yarns or other elongated groups of fibers, in accordance with some embodiments of the present invention. In this system 100, at least one polyester fiber 110 and at least one cotton fiber 120 are mixed together. In some embodiments, the preferred proportion of such mixing together of cotton fiber 120 and polyester fiber 110 is seventy percent (70%) cotton, thirty percent (30%) polyester (i.e., a 70/30 ratio). In some embodiments, polyester fiber 110 and cotton fiber 120 are blended using draw-frame blending. In some embodiments, polyester fiber 110 and cotton fiber 120 are blended using another blending method. In some methods according to the present invention, such blending may be carried out in accordance with the following steps (in any suitable order or number of iterations for each step): First, polyester fiber 110 and cotton fiber 120 are each kept in separate containers, such as example container 130, through a blowing process, in some embodiments. Next, separate slivers (or hanks) of fiber are made by intertwining fibers together and passing through rollers, in some embodiments. In some embodiments, the polyester fiber 110 is initially passed through a one-phase draw frame to keep the sliver tank optimal before both slivers are blended at a selected ratio. For example, in some embodiments, the ratio of the two fibers is 55/45 (i.e., fifty-five percent (55%) cotton and forty-five percent (45%) polyester).

In some embodiments, some fabrics in accordance with the present invention provide greater comfort than other fabrics, and may be worn more often during rest and leisure activities. In some such embodiments, some fabrics in accordance with aspects of the present invention are softer to the touch than other fabrics. In some embodiments, some fabrics in accordance with aspects of the present invention yield thermoregulatory effects or perceived thermoregulatory effects. For example, in some such embodiments, such fabrics yield a cooling sensation for a user. In some embodiments, some fabrics in accordance with aspects of the present invention are more resistant to soil and other infections than other fabrics. In some such embodiments, such fabrics may be worn more between washes, with less negative impacts for the user and the environment, than other fabrics.

In some embodiments, fabrics in accordance with the present invention (e.g., fabrics composed of a high proportion of cotton) have a particular composition (such as a yarn composition) yielding any of the advantages set forth above. In some embodiments, fabrics in accordance with the present invention have a particular finish, yielding any of the advantages set forth above.

Figure 2:
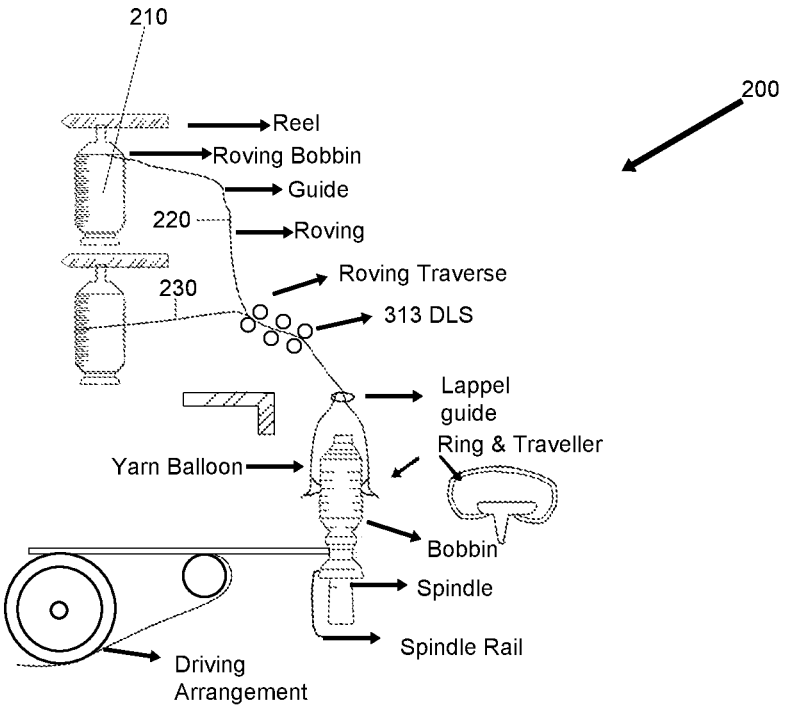
FIG. 2 is a perspective view of an example compact siro-spinning technology for generating a clothing fabric, in accordance with some embodiments of the present invention.

FIG. 2 is a perspective view of an example compact siro-spinning technology 200 for generating a clothing fabric, in accordance with some embodiments of the present invention. In some embodiments, siro-spinning is conducted on a compact ring frame 210 feeding two or more rovings, such as example roving 220 and example roving 230, into a drafting zone at a pre-determined separation. Compact siro-spinning incorporates features of compact spinning and siro-spinning systems, with several advantages over regular ring yarn. In some embodiments of the present invention, compact siro-spinning is used to create a cotton-rich fabric that is more aesthetically pleasing than cotton-rich fabrics made with other methods.

As discussed above, in some embodiments, cotton-rich fabrics according to the present invention are made draw-frame blending. In some embodiments, draw-frame blending of this nature, when used to create cotton-rich fabrics according to the present invention, achieves, or better achieves, equalizing. In some embodiments, such draw-frame blending of such cotton-rich fabrics, achieves, or better achieves, parallelizing. In some embodiments, such draw-frame blending of such cotton-rich fabrics achieves, or better achieves blending. In some embodiments, such draw-frame blending of such cotton-rich fabrics achieves, or better achieves, dust removal. In some embodiments, the evenness of a sliver used in creating such cotton-rich fabrics is improved. For example, in some embodiments, carded slivers that are fed to a draw frame have degrees of unevenness, and slivers from a comber may contain piecing, and an initial doubling process of compact siro-spinning serves to reduce such unevenness. The draft and doubling have the same value, in some embodiments. In some embodiments, such a value is between about six and eight. In some embodiments, such a value is in feet or inches. In some embodiments, unevenness is further reduced by an auto-leveling process. In some embodiments, fibers are arranged in parallel in a fiber strand. In some such embodiments, a value for strength is obtained as a yarn characteristic, based on such a parallel arrangement. In some embodiments, such a parallel arrangement is achieved with a draw frame. Each drafting leads to straightening of fibers, in some embodiments. In addition to equalizing, the doubling also provides some compensation for raw material variation, by blending, in some embodiments. In some embodiments, results of compact siro-spinning are exploited in the production of blended yarns comprising cotton or synthetic blends. In some such embodiments, at a draw frame, metering of individual components can be carried out by selecting the number of slivers entering the machines.

Figure 3:
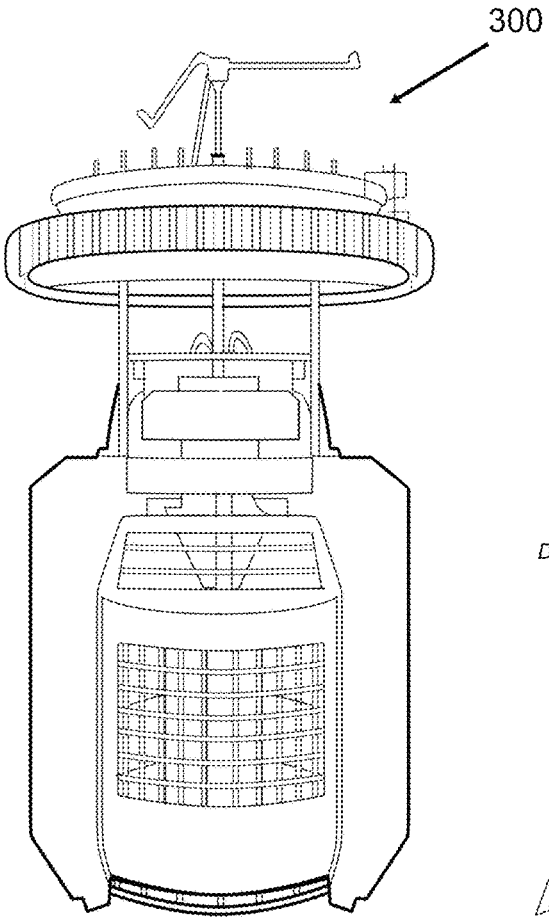
FIG. 3 is a perspective view of an example circular knitting machine, and a knitting sequence for creating a cotton-rich fabric, in accordance with some embodiments of the present invention.

FIG. 3 is a perspective view of an example circular knitting machine 300, and a knitting sequence for creating a cotton-rich fabric, in accordance with some embodiments of the present invention. In some embodiments, using a regular circular knitting machine 300, knitting may be sequenced using one hundred and eighteen (118) cones. In some embodiments, such one hundred and eight (108) cones include fifty-nine (59) cones of 37.5 technology fabric. In some embodiments, such one hundred and eighteen (118) cones include fifty-nine (59) cones of and XT2 fabric. In some embodiments, such one hundred and eighteen (118) cones include fifty-nine (59) cones of 37.5 technology fabric and fifty-nine (59) cones of and XT2 fabric. In some embodiments, the first feed is at a ratio of 60/1 cotton and the 37.5 technology fabric. In some embodiments, the second feed is of the XT2 fabric.

Figure 4:
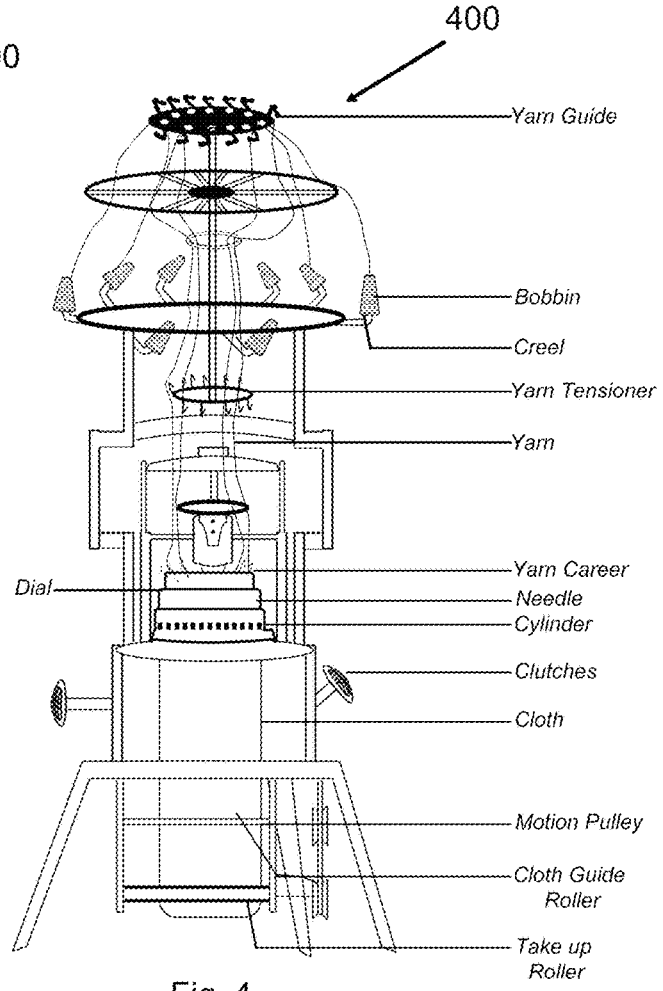
FIG. 4 is a front view of the same example circular knitting machine and knitting sequence for creating a cotton-rich fabric, of FIG. 3, discussed above, in accordance with some embodiments of the present invention.

FIG. 4 is a front view of the same example circular knitting machine 300 (now 400) and knitting sequence for creating a cotton-rich fabric, of FIG. 3, discussed above, in accordance with some embodiments of the present invention.

Figure 5:
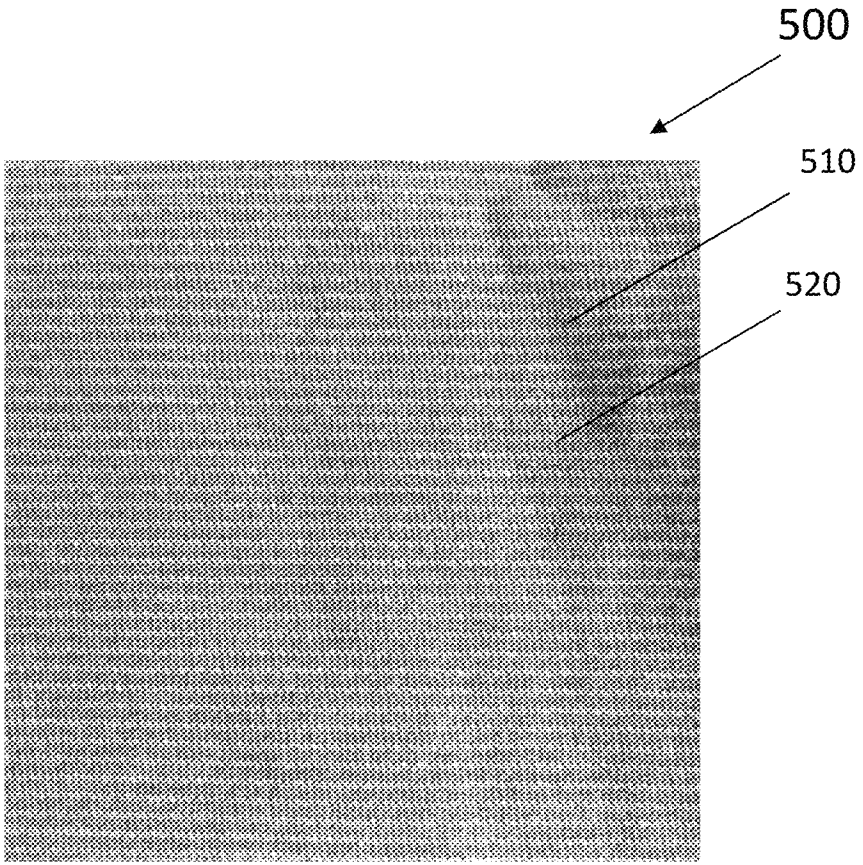
FIG. 5 is a top view of an example fabric swatch, in accordance with some embodiments of the present invention.

FIG. 5 is a top view of an example fabric swatch 500, in accordance with some embodiments of the present invention. In some embodiments, fabric swatch 500 includes a cotton-rich fabric, according to some embodiments of the cotton-rich fabrics set forth in this application. In some embodiments, fabric swatch 500 has been dyed. In some embodiments, fabric swatch 500 has been finished. In some embodiments, fabric swatch 500 has been died and finished. As pictured in the figure, fabric swatch 500 exhibits a unique predominantly horizontal linear texture. In some embodiments, that linear texture is due, at least in part, to a clear XT2 yarn being included in fabric swatch 500. In some embodiments, such a cotton-rich fabric includes dark-grey areas 510 that include a 60/1 cotton-polyester blend with the 37.5 technology. In some embodiments, such a cotton-rich fabric includes lighter-grey areas 520, which include portions of the fabric that have clear XT2 yarn. In some embodiments, the dark-grey areas 510 include a 60/1 cotton-polyester blend with the 37.5 technology, and the lighter-grey areas 520 include portions of the fabric that have clear XT2 yarn. The colors depicted are an example only, and any of the yarns may be dyed another color, in addition to, or instead of, the colors indicated.

Figure 6:
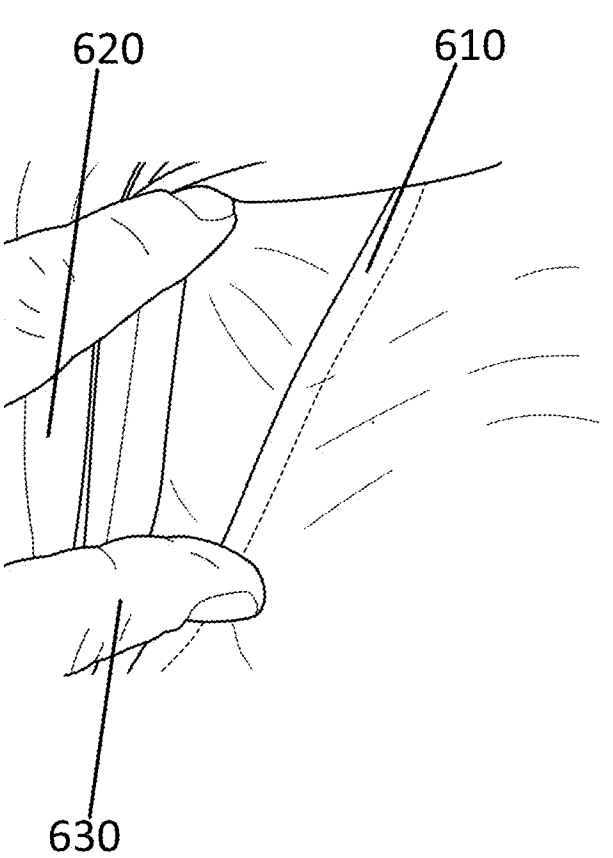
FIG. 6 is a perspective view of an example garment with a new form of pocket and enveloping sleeve, in accordance with some embodiments of the present invention.

FIG. 6 is a perspective view of an example garment 600 with a new form of pocket and enveloping sleeve, in accordance with some embodiments of the present invention. As illustrated, in some embodiments, garment 600 has at least one pocket 610. In some embodiments, pocket 610 includes an enveloping sleeve 620. In some such embodiments, enveloping sleeve 620 opens in a direction opposite to the direction of opening of an underlying pocket 610. In some embodiments, as pictured in the figure, a wearer 630 may access underlying pocket 610 of the garment 600 by shifting back enveloping sleeve 620 (e.g., as pictured). As one example method of use, while wearer 630 sits or raises her or his leg, enveloping sleeve 620 prevents objects, if any, within pocket 610 from falling out of enveloping sleeve 620. In some embodiments, enveloping sleeve 620 and pocket 610 do not include any fasteners for holding either or both of them closed. However, in some embodiments, any or all of the pocket 610, enveloping sleeve 620, and garment 600 is/are combined with other mechanisms for such closure. For example, in some embodiments, any or all of the pocket 610, enveloping sleeve 620, and garment 600 may be fastened to themselves or one another with the aid of one or more fastener(s). For example, in some embodiments, such one or more fastener(s) is/are button(s). As another example, in some embodiments, such one or more fastener(s) is/are snap(s). As another example, in some embodiments, such one or more fastener(s) is/are zipper(s). As another example, in some embodiments, such one or more fastener(s) include hook-and-loop fasteners(s), such as VELCRO. In some embodiments, a fastener may be included in the enveloping sleeve 620 and/or the pocket 610, allowing a user to fasten them together, better closing pocket 610, and safeguarding valuables within pocket 610 even further.

Figure 7:
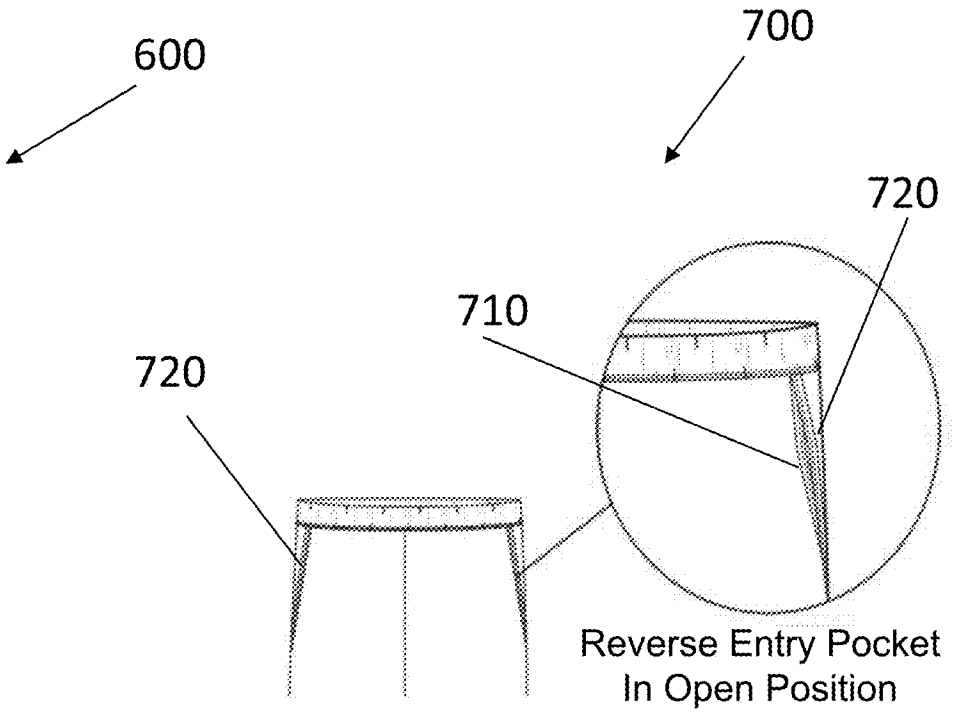
FIG. 7 is a front view of an example garment with a new form of pocket and enveloping sleeve, in accordance with some embodiments of the present invention.

FIG. 7 is a front view of an example garment 700 with a new form of pocket and enveloping sleeve, in accordance with some embodiments of the present invention. As illustrated, in some embodiments, garment 700 has at least one pocket 710, which has some structural aspects identical to the pocket 610, discussed above, but shown from a different, wider angle. Similarly to pocket 610, in some embodiments, pocket 710 is integral with or abuts an enveloping sleeve 720 of garment 700. In some such embodiments, enveloping sleeve 720 opens in a direction opposite to the direction of opening of an underlying pocket. A circled view to the right of the figure has been enlarged for magnification purposes, showing enveloping sleeve 720 in an open configuration, allowing access to pocket 710.

Figure 8:
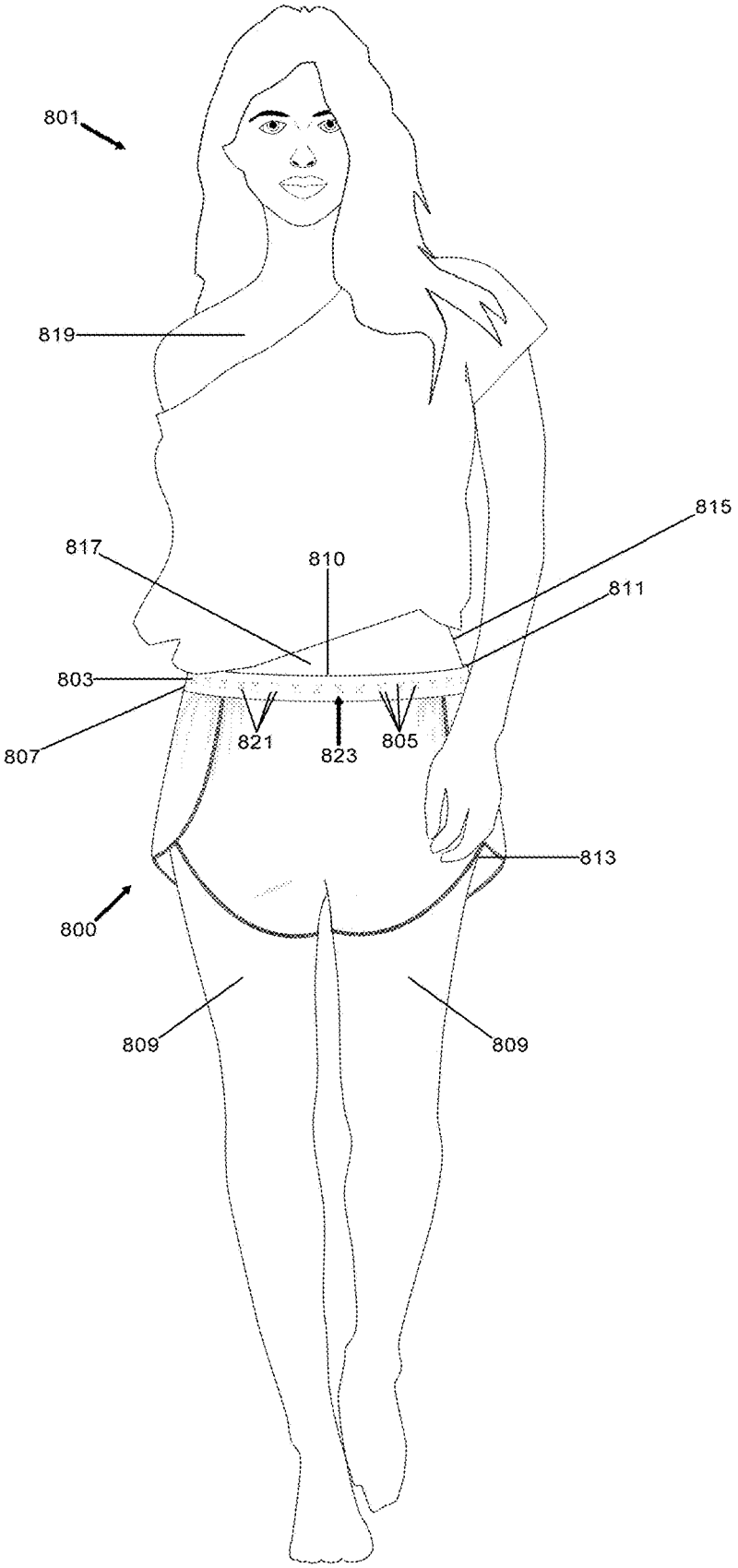
FIG. 8 is a perspective view of an example girl wearing an example garment, with an example pattern of grip-enhancing sub-elements, in accordance with some embodiments of the present invention.

FIG. 8 is a perspective view of an example girl 801 wearing an example garment, namely sleep- and leisure-enhancing shorts 800, with an example pattern 803 of grip-enhancing sub-elements, such as the examples shown as grip-enhancing sub-elements 805, on or about an example body-holding band 807, in accordance with some embodiments of the present invention. In some embodiments, such grip-enhancing sub-elements are mounted on a backer material, and such a body-holding band includes such a backer material. In other embodiments, such grip-enhancing sub-elements are integral with and formed as a part of such a body-holding band and/or backer material. In some embodiments, garment 800 includes a waistband 810. In some such embodiments, as will be discussed in greater detail below, waistband 810 includes grip-enhancing sub-elements, such as the examples shown as grip-enhancing sub-elements 805. In some embodiments, as also will be discussed in greater detail below, waistband 810 includes a body-holding band, such as example body-holding band 807, and grip-enhancing sub-elements 805. In some embodiments, grip-enhancing sub-elements are located on different aspects of a garment, in addition to or other than on a waistband. In some embodiments, such grip-enhancing sub-elements are located on part(s) of, but not all of, a waistband or other body-holding band. In still other embodiments, such grip-enhancing sub-elements are located entirely on another body-contacting surface, other than a body-holding band and on a garment without a body-holding band. As explained in greater detail below, grip-enhancing sub-elements 805 may be provided in a wide variety of different 2- and 3-dimensional shapes, and may include a wide variety of materials (e.g., silicone, fabric, rubber, plastic) with different properties (e.g., non-stick grip) in various embodiments of the invention. As also explained in greater detail below, in some embodiments, the grip-enhancing sub-elements, such as example grip-enhancing sub-elements 805, may, instead, or in addition to enhancing grip, enhance the positioning of a garment on a user's body and/or enhance the user's body shape and/or positioning. Garment 800 also includes several other unique design elements and useful advantages, some of which will be discussed in greater detail below.

In some embodiments, waistband 810 and body-holding band 807 include a band of material. For example, in some such embodiments, such a band of material includes an elastic material. In some embodiments, such a band of material is present on part of a waistband, such as waistband 810. In some embodiments, such an elastic material is present on part of a waistband. In other embodiments, a band of material is present on all or substantially all of a waistband, such as waistband 810. Likewise, in some embodiments, such an elastic material is present on all or substantially all of a waistband, such as waistband 810. In some embodiments, such a band and/or waistband includes a fastener (not pictured), such as any of the fasteners set forth in this application, or any other fastener available in the art of textiles and clothing. However, in some embodiments, such a band and/or waistband does not include a fastener, other than a band and/or waistband and grip-enhancing sub-elements. In some embodiments, a user may use a waistband in accordance with aspects of the present invention to hold her or his garment in place, and/or aid in maintaining a suitable alignment or other positioning of her or his garment. For example, in some embodiments, a user may use a waistband in accordance with aspects of the present invention to hold her or his garment on or about her or his waist.

For example, because grip-enhancing sub-elements 805 may line an inward-facing surface (facing away from the viewer, in the perspective of FIG. 8) of the part of waistband 810 visible in the figure, and the texture created by grip-enhancing sub-elements 805 enhances grip against girl 801's body, and encourages the proper alignment and positioning of sleep- and leisure-enhancing shorts 800, girl 801 may use grip-enhancing sub-elements 805 to better position and retain a preferred placement of sleep- and leisure-enhancing shorts 800 on her body, according to some embodiments. For example, in some embodiments, as pictured, girl 801 may don sleep- and leisure-enhancing shorts 800 by slipping both of her legs 809 through a top opening 811 of leisure-enhancing shorts 800, widening waistband 810, allowing her to slide them up, past the wider profile of her hips 813, until waistband 810 is positioned at the narrower part of her body at her waist 815. Girl 801 may then tighten waistband 810 (e.g., by allowing an elastic material to pull it inward), resulting in grip-enhancing sub-elements 805 pressing inward against or towards her skin 817, and body 819. So positioned, grip-enhancing sub-elements 805 will tend to slide slightly downward with gravity until coming to a rest with the increasing pressure caused by waistband 810 as it begins to push against the width of her hips 813, below, until coming to a rest at a slightly lower position (as pictured) than the narrower, higher vertical position of her waist 815. As this occurs, leading members of grip-enhancing sub-elements 805 disposed on the side of waistband 810 facing the direction of that movement downward, such as example leading members 821, will tend to spread and move downward the most of all grip-enhancing sub-elements 805, and seat in grip- and position-enhancing and/or body-shaping lines of movement, in some embodiments.

In various embodiments, pattern 803 may be of any shape, size, plurality or arrangement of particular sub-elements, such as, but not limited to, any of example grip-enhancing sub-elements 805. Also in various embodiments, a gripping pattern or texture may include fewer or more grip enhancing sub-elements than that pictured. However, in some embodiments, certain particular pattern(s) of a plurality of grip-enhancing sub-elements are preferred (as discussed further).

In some embodiments, at least part of waistband 810, and/or at least part of pattern 803, includes a sub-pattern(s) of grip-enhancing sub-elements, such as example sub-pattern of five (5) grip-enhancing sub-elements 823, shown lining at least part of an inward-facing surface of waistband 810. This, and other such patterns of grip-enhancing sub-elements, and various possible placements thereof, will be discussed in greater detail below.

For example, as pictured, such grip-enhancing sub-elements are provided in a form of repeating groups in some embodiments, as pictured along the length of the waistband 810. In other embodiments, any of a wide variety of other possible repeating patterns may be included. In some embodiments, such patterns (e.g., repeating groups of five (5) grip-enhancing sub-elements) are spaced at regular intervals, as pictured. Such spacing, and the number of such repeating patterns, may be selected to uniformly cover a given waistband or other material of a particular length or other size, or by some other ideal spacing and number, in some embodiments. In some embodiments, such repeating patterns are spaced 0.5 inches apart from one another, or at about that spacing. In some embodiments, such repeating patterns may be spaced to include 9 such repeating patterns, evenly distributed across all or a part of a band of material, or the waistband 810. In some embodiments, such repeating patterns may be spaced to include 8 such repeating patterns, evenly distributed across all or a part of a band of material, or the waistband 810 (as pictured in FIGS. 9, 10 and 12, discussed in greater detail below). In some embodiments, such groups of five include an X-shaped arrangement of grip-enhancing sub-elements, such as the example pictured. As with the spacing between such patterns, the spacing between the individual grip-enhancing sub-elements within such patterns may be of any number of uniform or other (e.g., randomized) spacing. In some embodiments, still other patterns and numbers of grip-enhancing sub-elements, which may or may not be arranged in repeating or spaced intervals, may be provided. For example, in some embodiments, the grip-enhancing sub-elements are selected from a shape and/or arranged in a pattern to prevent a waistband from folding over onto itself, or twisting out of place, when donned and/or worn. In some such embodiments, the area of the waistband on or about an edge of the waistband facing or nearer to a pulling force (such as the lower edge of the waistband, as against gravity) than another edge(s), about an edge further from a pushing force (such as the lower edge of the waistband, facing away from the downward force of a users hands against the top of the waistband) may have a lower number or density, and a lower surface area of grip-enhancing sub-elements, than another edge or part of the waistband (see, e.g., FIGS. 11 and 12, below). However, in other embodiments, other densities, distributions, and gradients of grip-enhancing members are, instead or in addition, be used. Examples of some of each of the embodiments mentioned above will be provided in greater detail below.

In some embodiments, such grip-enhancing sub-elements are exposed, and directly contact a wearer's body, at or about the waistline, when garment 800 is donned. In some such embodiments, the appearance of such grip-enhancing sub-elements may be enhanced. For example, in some such embodiments, such grip-enhancing sub-elements may be slightly or brightly colored, and arranged in aesthetically-pleasing patterns (e.g., a logo). In some embodiments, however, fabric and/or another material(s) of garment 800 at least partially cover at least some of such grip-enhancing sub-elements. In such embodiments, because such fabric and/or another material(s) is/are flexible and compressible, such grip-enhancing sub-elements create unique body-holding and/or garment-positioning patterns on the body-facing surface(s) of such fabric and/or other material(s), especially when donned. However, in some such embodiments, such grip-enhancing sub-elements are not visible, or, at least, not plainly visible, due to such fabric and/or another material(s) covering them. In some embodiments, such covering may be sewn or otherwise adhered in place, preventing access to such grip-enhancing sub-elements unless the garment is opened up.

As mentioned above, and as will be discussed in greater detail below, in some embodiments, a band of material (e.g., an elastic or other band) or other backing material bears a given pattern of grip-enhancing sub-elements. In some such embodiments, such a band may be mounted to a garment. In some such embodiments, such a band may be held and welded, tacked, glued, sewn or otherwise joined to another material of the garment. Such embodiments may be particularly useful in garments including a slippery material, such as silk. For example, in some embodiments, such a band is tacked within a channel formed within another material of such a garment. In some such embodiments, such a band is tacked periodically within a channel formed at the waistband of a garment. As another example, in some embodiments, grip-enhancing sub-elements are held within a channel formed within a material of a garment.

In some embodiments, grip-enhancing sub-elements are integral with or joined directly to a material or fabric forming at least part of the remainder of garment 800. For example, in some embodiments, grip-enhancing sub-elements are integral with at least a part of waistband 810. In some embodiments, such grip-enhancing sub-elements may be fastened and/or otherwise joined to any of such materials or fabrics. However, in some such embodiments, such fastening or otherwise joining is carried out only on fabrics where such fastening and/or joining does not compromise the integrity and/or durability of the fabric. For example, in some embodiments, such grip-enhancing sub-elements may be bonded to such materials and/or fabrics. As another example, in some embodiments, such materials or fabrics may be glued to any of such materials and/or fabrics. As another example, in some embodiments, such materials or fabrics may be sewn to any of such materials or fabrics. As another example, in some embodiments, such materials or fabrics may be mounted to any of such materials or fabrics with an adhesive.

Such grip-enhancing sub-elements may be created from a wide variety of suitable materials, in various embodiments of the invention. In some embodiments, such grip-enhancing sub-elements include silicone. In some such embodiments, such a silicone material is, or is treated or conditioned with, a non-stick material. In some embodiments, such grip-enhancing sub-elements include an elastomeric material. In some embodiments, such grip-enhancing sub-elements include a transparent material. In some embodiments, such grip-enhancing sub-elements include a translucent material. In some embodiments, such grip-enhancing sub-elements include an opaque material. In some embodiments, such grip-enhancing sub-elements include silicone gel. In some embodiments, such grip-enhancing sub-elements include rubber. In some embodiments, such grip-enhancing sub-elements include plastic. In some embodiments, such grip-enhancing sub-elements include thermoplastic polyurethane (a.k.a. "TPU"). In some embodiments, such grip-enhancing sub-elements include a material that is resistant to oils. In some embodiments, such grip-enhancing sub-elements include a material that is resistant to another substance likely to be contacted (e.g., sweat, cosmetics and other clothing materials). In some embodiments, such grip-enhancing sub-elements include an adhesive gel.

Similarly, in various embodiments, any band of material or other backer on which grip-enhancing sub-elements are mounted, joined, or are integral with, may be created from a wide variety of suitable materials. For example, in some embodiments, such a backer includes elastic. In some such embodiments, such a backer is in the form of an elastic band(s). As another example, in some embodiments, such a backer includes silicone. In some such embodiments, such a silicone material is, or is treated or conditioned with, a non-stick material. In some embodiments, such a backer includes an elastomeric material. In some embodiments, such a backer includes a transparent material. In some embodiments, such a backer includes a translucent material. In some embodiments, such a backer includes an opaque material. In some embodiments, such a backer includes silicone gel. In some embodiments, such a backer includes rubber. In some embodiments, such a backer includes plastic. In some embodiments, such a backer includes thermoplastic polyurethane (a.k.a. "TPU"). In some embodiments, such a backer includes a material that is resistant to oils. In some embodiments, such a backer includes a material that is resistant to another substance likely to be contacted (e.g., sweat, cosmetics and other clothing materials). In some embodiments, such a backer includes an adhesive gel.

In some embodiments, a user may provide or wear garment 800 to experience less repositioning, moving, twisting, bunching, folding, and slipping of garments on or about the body. In some such embodiments, a user may provide or wear garment 800 for relaxation or leisure activities. In some such embodiments, a user may provide or wear garment 800 to enhance sleep.

Although the example of a garment with a waistband including grip-enhancing sub-elements has been provided in FIG. 8, it should be understood that this embodiment is merely an example, and any suitable material or surface that comes in contact with, or otherwise holds, part of a human body may include such grip-enhancing sub-elements, and patterns thereof, in various embodiments (e.g., on any skin-contacting surface, such as an inward-facing surface). Such materials and surfaces include, but are not limited to: cuffs, hems, collars, straps, bands, wraps, belts, and bracelets. In other embodiments, any band or other material surface contacting a wearer's body, or clothing over her or his body, may include such grip-enhancing sub-elements. For example, in some embodiments, any of the grip-enhancing sub-elements, or patterns thereof, set forth in this application may be provided on a wristband. As another example, such grip-enhancing sub-elements, or patterns thereof, may be provided on armband. As another example, such grip-enhancing sub-elements, or patterns thereof, may be provided on or wrist cuff. As another example, such grip-enhancing sub-elements, or patterns thereof, may be provided on an ankle band. As another example, such grip-enhancing sub-elements, or patterns thereof, may be provided on the cuff of a pants leg. As another example, such grip-enhancing sub-elements, or patterns thereof, may be provided on a sleep mask (e.g., on the interior surface contacting a user's forehead). As another example, such grip-enhancing sub-elements, or patterns thereof, may be provided on a collar. As another example, such grip-enhancing sub-elements, or patterns thereof, may be provided on a choker. As another example, such grip-enhancing sub-elements, or patterns thereof, may be provided on a necklace. As another example, such grip-enhancing sub-elements, or patterns thereof, may be provided on a bralette. As another example, such grip-enhancing sub-elements, or patterns thereof, may be provided on the interior surface covering a wearer's shoulders. As another example, such grip-enhancing sub-elements, or patterns thereof, may be provided on bottoms. As another example, such grip-enhancing sub-elements, or patterns thereof, may be provided on pants. As another example, such grip-enhancing sub-elements, or patterns thereof, may be provided on leggings. As another example, such grip-enhancing sub-elements, or patterns thereof, may be provided on tights. As another example, such grip-enhancing sub-elements, or patterns thereof, may be provided on shorts. As another example, such grip-enhancing sub-elements, or patterns thereof, may be provided on a belt. As another example, such grip-enhancing sub-elements, or patterns thereof, may be provided on socks (e.g., at the ankle, or on a bottom surface of socks). As another example, such grip-enhancing sub-elements, or patterns thereof, may be provided on underwear. As another example, such grip-enhancing sub-elements, or patterns thereof, may be provided on panties, or the waistband thereof. As another example, such grip-enhancing sub-elements, or patterns thereof, may be provided on sweat pants. As another example, such grip-enhancing sub-elements, or patterns thereof, may be provided on a skirt. As another example, such grip-enhancing sub-elements, or patterns thereof, may be provided on a slip. As another example, such grip-enhancing sub-elements, or patterns thereof, may be provided on a vest. As another example, such grip-enhancing sub-elements, or patterns thereof, may be provided on a bracelet. As another example, such grip-enhancing sub-elements, or patterns thereof, may be provided on a headband. As another example, such grip-enhancing sub-elements, or patterns thereof, may be provided on a hat. As another example, such grip-enhancing sub-elements, or patterns thereof, may be provided on a turban or other religious or ceremonial head covering or adornment. As another example, such grip-enhancing sub-elements, or patterns thereof, may be provided on a scrunchie (e.g., on the hair-gripping section). As another example, such grip-enhancing sub-elements, or patterns thereof, may be provided on a tightening band (e.g., as a scrunchie). In some such embodiments, such grip-enhancing sub-elements may serve as a stopper, preventing the ingress or egress of a tightening band through an opening in a housing through which it is threaded. As another example, such grip-enhancing sub-elements, or patterns thereof, may be provided on jewelry. As another example, such grip-enhancing sub-elements, or patterns thereof, may be provided on a dress. As another example, such grip-enhancing sub-elements, or patterns thereof, may be provided on stockings. As another example, such grip-enhancing sub-elements, or patterns thereof, may be provided on boots. As another example, such grip-enhancing sub-elements, or patterns thereof, may be provided on sneakers. As another example, such grip-enhancing sub-elements, or patterns thereof, may be provided on gloves. As another example, such grip-enhancing sub-elements, or patterns thereof, may be provided on grippable surfaces of sporting equipment. As another example, such grip-enhancing sub-elements, or patterns thereof, may be provided on bandages or body supports. As another example, such grip-enhancing sub-elements, or patterns thereof, may be provided on safety equipment. In other various embodiments, such grip-enhancing sub-elements, or patterns thereof, may be provided on or about any surface of clothing, equipment or any other materials that may come in contact with a human body.

Figure 9:
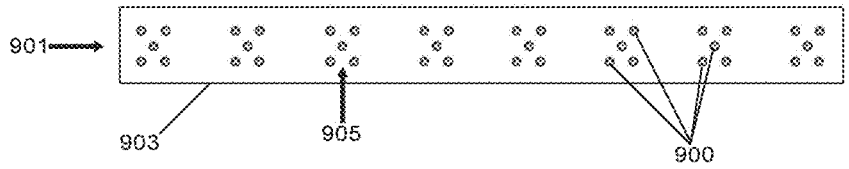
FIG. 9 is an enlargement, for magnification purposes, of some aspects set forth in FIG. 8, showing details of an example pattern of grip-enhancing sub-elements on or about an example body-holding band, in accordance with some embodiments of the present invention.

FIG. 9 is an enlargement, for magnification purposes, of some aspects set forth in FIG. 8, showing details of an example pattern 901 of grip-enhancing sub-elements (such as the examples shown as 900) on or about an example body-holding band 903, in accordance with some embodiments of the present invention. As discussed above, in relation to FIG. 8, and further, below, such a body holding band 903 may be placed in any number of garment locations, on a wide variety of garments, to aid in positioning and holding garments in place on a user's body. Due to the enlargement, the spacing between repeating triplet patterns of grip-enhancing sub-elements can be more clearly seen. Similarly, the generally round, convex shape of the example grip-enhancing sub-elements can also be seen, due to shading. In some embodiments, as pictured, the grip-enhancing sub-elements may be of the same, or a coordinated color, with the waistband on which they are mounted (or with which they are integrated). In some embodiments, however, grip-enhancing sub-elements may be of a contrasting color. In some embodiments, grip-enhancing sub-elements may be of a clear or translucent material, as discussed elsewhere in this application.

As discussed above, example pattern 901 can be conceptualized as a series of uniformly-spaced, repeating sub-pattern elements—namely, several generally X-shaped sub-patterns, such as the example shown as 905. Among other aspects, this particular pattern 901, and sub-pattern 905, aids in positioning, holding and retaining the mounted position of a waistband in which it is mounted (among other things) by gathering and holding skin centrally, under pressure. As also discussed above, particular patterns and sub-pattern elements aid in the dynamic positioning, meaning that the movement of the grip-enhancing sub-elements against a user's skin and body result in superior alignment and positioning of a garment on which they are mounted, in some embodiments.

Such spacing, and the number of such repeating patterns, may be selected to uniformly cover a given waistband or other material size, or by some other ideal spacing and number, in some embodiments. In some embodiments, such repeating patterns may be spaced 0.5 inches apart from one another, or at about that spacing. In some embodiments, such repeating patterns may be spaced to include 8 such repeating patterns, evenly distributed across a body-holding band. As with the spacing between such patterns, the spacing between the individual grip-enhancing sub-elements within such patterns may be of any number of uniform or other (e.g., randomized) spacing, in addition to the example spacing as pictured, between them.

As discussed above, and as with other patterns of grip-enhancing sub-elements on or about an example body-holding band set forth in the present application, example pattern 901 of grip-enhancing sub-elements on or about an example body-holding band 903 may be disposed on or within any number of possible body-contacting pieces of material. For example, in some embodiments, such as that pictured in FIG. 8, above, example pattern 901 of grip-enhancing sub-elements may be disposed on or about a waistband of shorts, such as example waistband 810 of example shorts 800.

Figure 10:
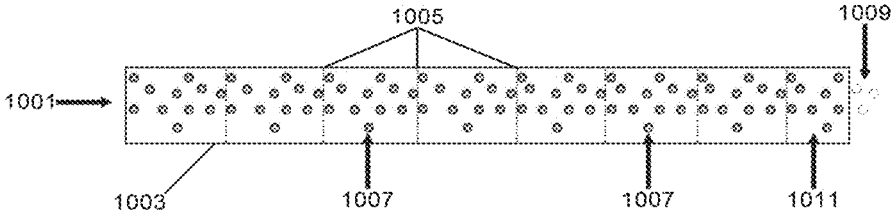
FIG. 10 is a front view of another example pattern of grip-enhancing sub-elements on or about an example body-holding band, in accordance with some embodiments of the present invention.

FIG. 10 is a front view of another example pattern 1001 of grip-enhancing sub-elements on or about an example body-holding band 1003, in accordance with some embodiments of the present invention. As with pattern 901, discussed above, and other patterns of grip-enhancing sub-elements discussed in the present application, pattern 1001 can be conceptualized as including a series of repeating subunits or sub-patterns, and may be shown between example unit-separating markers, such as the examples shown as unit-separating markers 1005. However, in the example pattern provided, and in contrast with some other embodiments, the repeating sub-pattern elements, such as the examples shown as repeating sub-pattern elements 1007, are not uniformly shaped or spaced apart from one another. Instead, the grip-enhancing sub-elements within each of the repeating sub-pattern elements 1007 vary slightly in terms of internal spacing and vertical and horizontal placement. In some embodiments, such variations are random. In some embodiments, such variations are pseudo-random. In some embodiments, such variations are non-random. In some embodiments, such variations are within certain constraints on variation (e.g., a movement limit).

Also in contrast with some other patterns set forth in this application, at least some of the series of repeating sub-pattern elements 1007 are partially included within body-holding band 1003, as shown by example omitted segment 1009 of sub-pattern element 1011.

Figure 11:
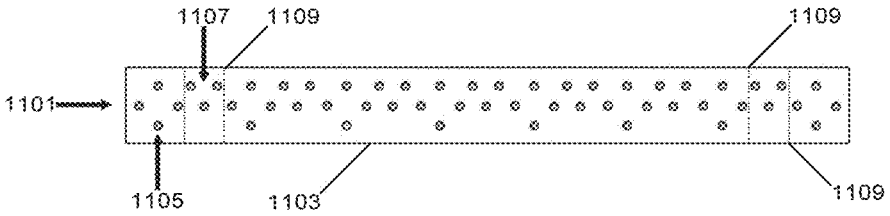
FIG. 11 is a front view of another example pattern of grip-enhancing sub-elements on or about an example body-holding band, in accordance with some embodiments of the present invention.

FIG. 11 is a front view of another example pattern 1101 of grip-enhancing sub-elements on or about an example body-holding band 1103, in accordance with some embodiments of the present invention. As with pattern 901 and pattern 1001, discussed above, and other patterns of grip-enhancing sub-elements discussed in the present application, pattern 1101 can be conceptualized to consist of a series of repeating subunits or sub-patterns, such as example capping subunit 1105 and interior subunit 1107, shown between example unit-separating markers, such as the examples shown as unit-separating markers 1109. However, unlike some other patterns, the repeating subunits of pattern 1101 are not substantially spaced from one another (at least, in the horizontal direction). Also unlike some other patterns set forth in this application, some subunits are repeated more often than other subunits. For instance, in the example pictured, the example ending and beginning subunits, at either end of body-holding band 1103 (a.k.a., the capping subunits), such as example capping subunit 1105, are of a sub-pattern that appears more often than another pattern, of the other type of subunit (a.k.a. entirely interior subunits), such as entirely interior subunit 1107.

Figure 12:
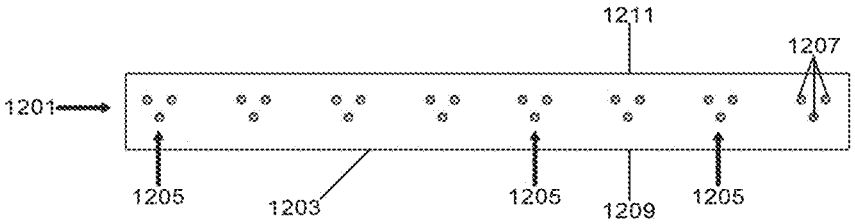
FIG. 12 is a front view of another example pattern of grip-enhancing sub-elements on or about an example body-holding band, in accordance with some embodiments of the present invention.

FIG. 12 is a front view of another example pattern 1201 of grip-enhancing sub-elements on or about an example body-holding band 1203, in accordance with some embodiments of the present invention. As with pattern 901, discussed above, and other patterns of grip-enhancing sub-elements discussed in the present application, pattern 1201 includes a series of spatially-separated, repeating subunits, such as the examples shown as repeating sub-pattern elements 1205. Sub-pattern elements 1205 can be conceptualized as repeating triplets of grip-enhancing sub-elements, arranged generally in a triangular formation, such as the formation shown as 1207. Because each of such triangular formations, such as 1207, is pointed downwards, fewer grip-enhancing sub-elements are disposed nearer to the bottom edge 1209 of body-holding band 1203, than nearer to the top edge 1211, of body-holding band 1203. As a result, and as discussed above with respect to other example patterns of grip-enhancing sub-elements, body-holding band 1203 resists buckling and folding over, and tends to reposition and hold itself in a proper orientation on a user's body when donned, and pulled downward (e.g., with gravity).

It should be noted that embodiments of patterns discussed in reference to FIGS. 10 and 11 also have a greater density of grip-enhancing sub-elements on an edge facing in the direction of movement and/or force, and also exhibit such benefits.

Figure 13:
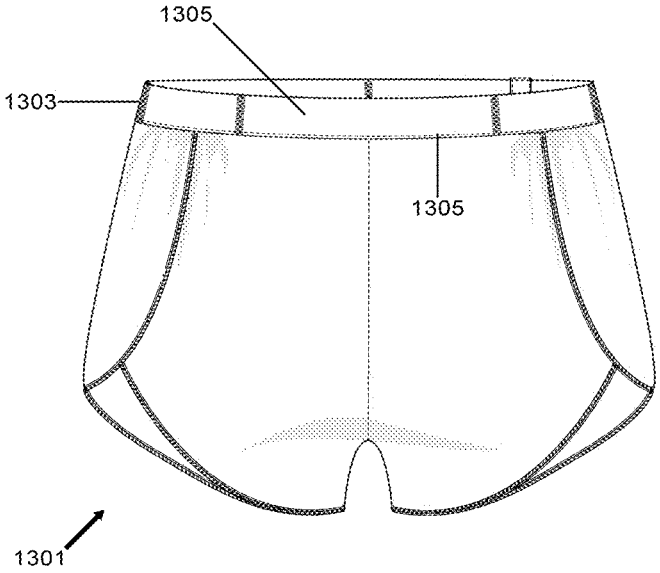
FIG. 13 is a front perspective view of aspects an example garment, similar in nature to the garment shown in FIG. 8, above, but without a pattern of grip-enhancing sub-elements yet installed, in accordance with aspects of the present invention.

FIG. 13 is a front perspective view of aspects an example garment 1301 (namely, a pair of sleep- and leisure-enhancing shorts), similar in nature to a garment shown in FIG. 8, above, but without a pattern of grip-enhancing sub-elements, or backer material including them, yet installed, in accordance with aspects of the present invention. As with the example sleep- and leisure-enhancing shorts 800, set forth in FIG. 8, garment 1301 includes a waistband, now shown as 1303. Within waistband 1303, an interior channel 1305 is included. In some embodiments, interior channel 1305 is provided in a generally elongated, narrow, rectangular form, such that it is complementary to, and able to receive and hold, any of the body-holding bands set forth above, in reference to FIGS. 9-12.

Figure 14:
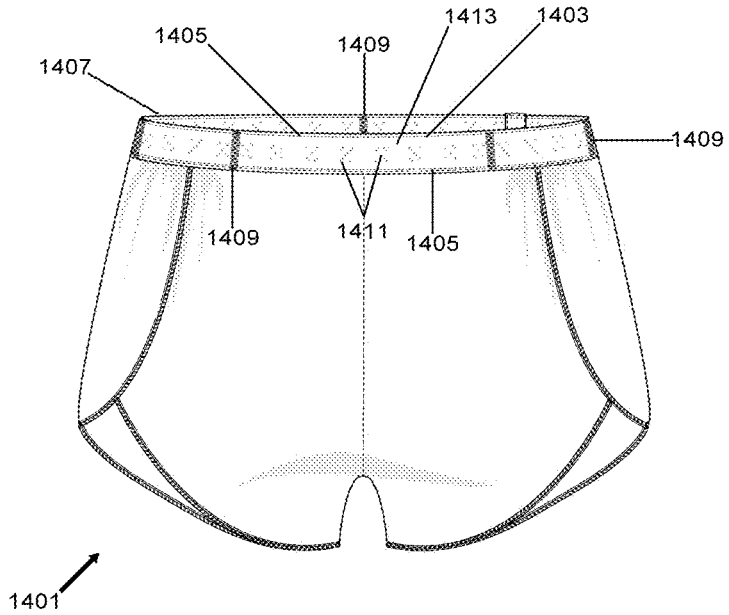
FIG. 14 is a front perspective view of aspects an example garment, similar in nature to the garment shown in FIG. 13, above, but with a pattern of grip-enhancing sub-elements on a backer material installed within it, in accordance with aspects of the present invention.

FIG. 14 is a front perspective view of aspects an example garment 1401 (namely, a pair of sleep- and leisure-enhancing shorts), similar in nature to the garment shown in FIG. 13, above, but with a pattern of grip-enhancing sub-elements on a backer material (namely, body-holding band 1403) installed within its interior channel (now shown as channel 1405), in accordance with aspects of the present invention. As mentioned above, a series of attachments join body-holding band 1403 to channel 1405 and to the waistband 1407 in general, of garment 1401. These attachments, such as example bonds 1409, preferably join body-holding band 1403 to all surfaces of channel 1405 and waistband 1407. However, in some embodiments, at least one of the two largest flat side panels forming the inner channel 1405 is bonded to body-holding band 1403. The number of attachments shown, which are periodically spaced, are merely an example of the possible number and density of such attachments in accordance with the present invention. In some embodiments, different attachments, other than bonding, may be used. For example, in some embodiments, sewing is used, with strong stitches (e.g., a top stitch), at the same positions as, and/or in addition to, bonds 1409. As another example, in some embodiments, adhesives are used, at the same positions as, or in addition to, bonds 1409. In some embodiments, multiple forms of such attachments are used.

Unlike the example shorts 800 in FIG. 8, above, parts of the entire circumference of waistband 1407 of example garment 1401 can be seen in the present figure. In addition, grip-enhancing sub-elements, such as the examples shown as grip-enhancing elements 1411, on a backer material 1413, are shown on that entire circumference. Although each of the grip-enhancing sub-elements are covered by garment material of the waistband 1407 (unless a transparent or light material is used, revealing them), each of the grip-enhancing sub-elements' position is revealed for illustrative purposes. It should be understood that the grip-enhancing sub-elements are disposed on, or facing, the interior-facing side of, waistband 1407, allowing them to apply pressure to a wearer's body after donning garment 1401, as discussed in greater detail in other parts of this application.

Figure 15:
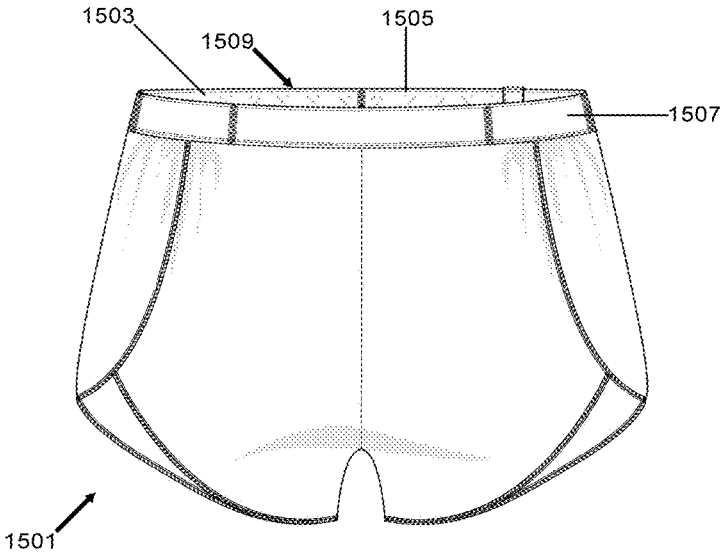
FIG. 15 is a front perspective view of aspects of an example garment, similar in nature to the garment shown in FIG. 14, above, with a pattern of grip-enhancing sub-elements on a backer material installed within it on one side of the garment, in accordance with aspects of the present invention.

FIG. 15 is a front perspective view of aspects of an example garment 1501 (namely, a pair of sleep- and leisure-enhancing shorts), similar in nature to the garment shown in FIG. 14, above, with a pattern of grip-enhancing sub-elements on a backer material (body-holding band 1503) installed within its interior channel (now shown as channel 1505), in accordance with aspects of the present invention. However, unlike with example garment 1401, grip-enhancing sub-elements on a backer material of example garment 1501 do not line the entire channel 1505, or entire waistband (now shown as waistband 1507) of example garment 1501. Instead, the grip-enhancing sub-elements on a backer material line a back portion 1509, only, of waistband 1507, as pictured.

As with example garment 1401, it should be understood that the grip-enhancing sub-elements are disposed on, or facing, the interior-facing side of, waistband 1507, allowing them to apply pressure to a wearer's body after donning garment 1501, as discussed in greater detail in other parts of this application.

Figure 16:
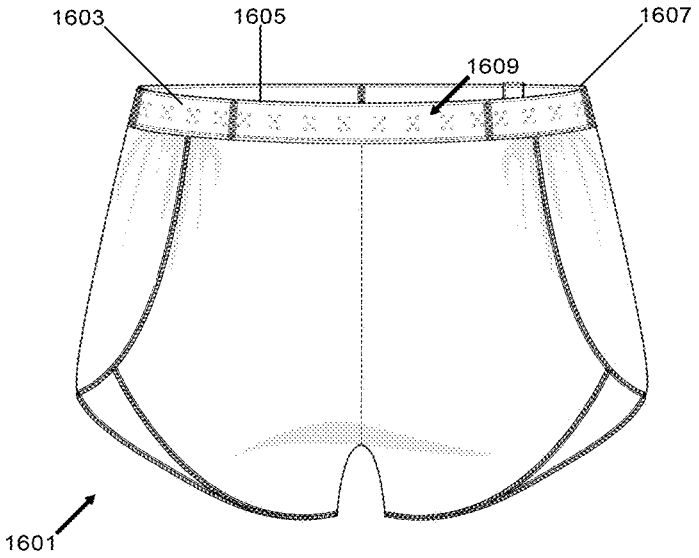
FIG. 16 is a front perspective view of aspects an example garment, similar in nature to the garment shown in FIG. 15, above, with a pattern of grip-enhancing sub-elements on a backer material installed on another side of the garment, in accordance with aspects of the present invention.

FIG. 16 is a front perspective view of aspects an example garment 1601 (namely, a pair of sleep- and leisure-enhancing shorts), similar in nature to the garment shown in FIG. 14, above, with a pattern of grip-enhancing sub-elements on a backer material (body-holding band 1603) installed within its interior channel (now shown as channel 1605), in accordance with aspects of the present invention. However, unlike with example garment 1401, grip-enhancing sub-elements on a backer material of example garment 1501 do not line the entire channel 1605, or entire waistband (now shown as waistband 1607) of example garment 1601. Instead, the grip-enhancing sub-elements on a backer material line a front portion 1609, only, of waistband 1507.

As with example garment 1401 and example garment 1501, it should be understood that the grip-enhancing sub-elements are disposed on, or facing, the interior-facing side of, waistband 1607, allowing them to apply pressure to a wearer's body after donning garment 1601, as discussed in greater detail in other parts of this application.

As discussed above, such a body holding band 1603 may be placed in any number of garment locations, on a wide variety of garments, to aid in positioning and holding garments in place on a user's body. For example, in some embodiments, the same band 1603 may be moved to another location, such as the location shown for band 1503, by opening up the channel 1605 of garment 1601, at the discretion of a user.

Figure 17:
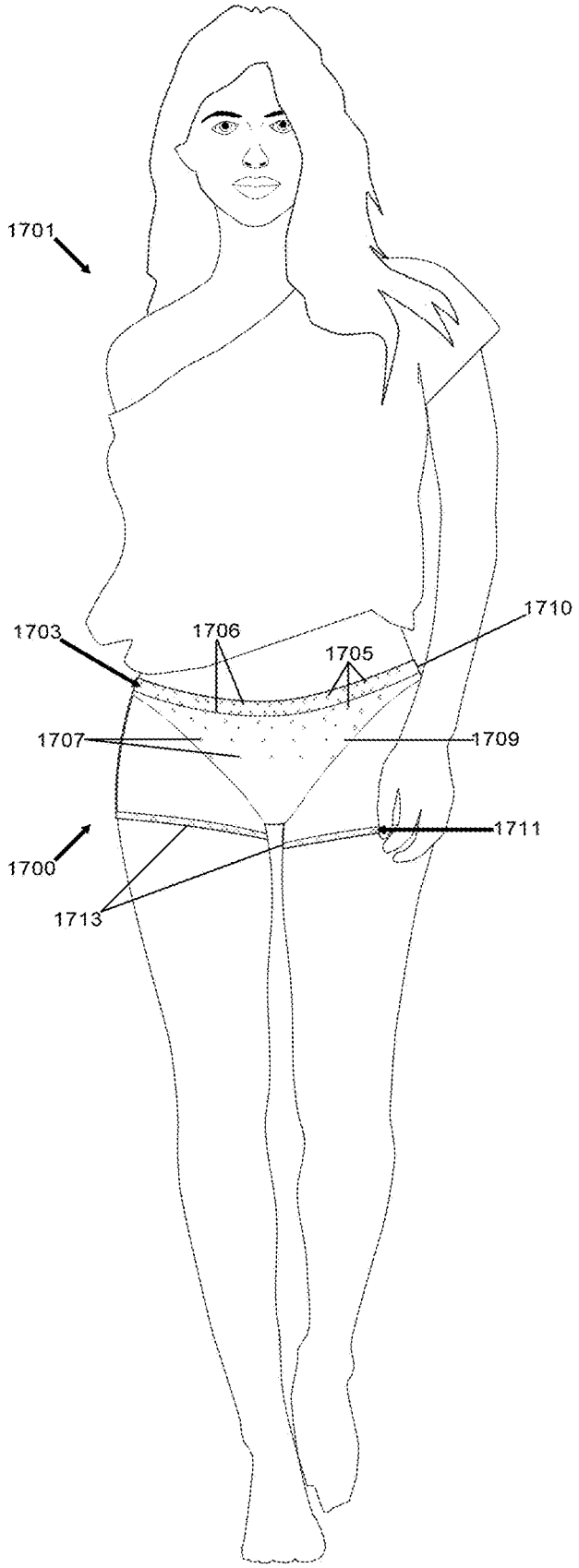
FIG. 17 is a perspective view of an example girl wearing a new example garment, namely sleep- and leisure-enhancing tight briefs, with an example pattern of grip-enhancing sub-elements lining an extended interior surface.

FIG. 17 is a perspective view of an example girl 1701 wearing a new example garment, namely sleep- and leisure-enhancing tight briefs 1700 with an example pattern 1703 of grip-enhancing sub-elements, such as the examples shown as grip-enhancing sub-elements 1705. Unlike some other patterns of grip-enhancing sub-elements set forth in this application, example pattern 1703 includes grip-enhancing sub-elements that extend beyond the waistband 1710 of the garment. Although some grip-enhancing sub-elements, such as example grip-enhancing sub-elements 1706, are disposed on or about waistband 1710, others, such as example grip-enhancing sub-elements 1707, are disposed over a wider area—namely, an interior piece of fabric 1709.

As with some other patterns of grip-enhancing sub-elements set forth in the present application, grip-enhancing sub-elements 1705 have a decreasing density, in accordance with a gradient, in some directions.

Also pictured is a different pattern 1711 of grip-enhancing sub-elements, located on leg-gripping bands 1713. The decreasing density of grip-enhancing sub-elements in pattern 1711 on leg-gripping bands 1713, in this instance, progresses upwards, to confer similar benefits as other patterns of grip-enhancing sub-elements set forth in this application, but as against an upward force (e.g., elastic pulling upward from the remainder of tight briefs 1700).

Figure 18:
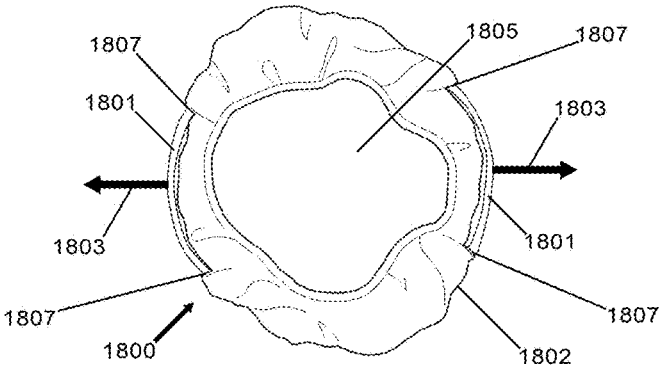
FIG. 18 is a side view of an example new form of hair tie, in accordance with some embodiments of the present invention.

FIG. 18 is a top view of an example new form of hair tie 1800, in accordance with some embodiments of the present invention. In some embodiments, hair tie 1800 is generally in the form of a scrunchie, meaning that it comprises a looped or generally circular band or cord (not fully pictured in the present figure), generally surrounded by a fabric 1802 that tends to form wrinkles due to the elastic band or cord's tendency to bunch the surrounding fabric as it pulls concentrically inward. Hence the term, "scrunchie," from the word "scrunch," signifying that the fabric tends to "draw or squeeze together tightly" or "crumple." See generally, Webster's Collegiate Dictionary, entry for "scrunch," senses 2*a* and 2*b*, accessed online Oct. 13, 2019. As pictured in the present figure, just two exposed portions 1801 of the looped or generally circular band or cord are shown, exposed and outside of fabric 1802. In some embodiments, exposed portions 1801 may sum to approximately one-third ($1/3^{rd}$) of the overall circumference of hair tie 1800. In some embodiments, exposed portions 1801 may be approximately one (1) inch in length, each. As will be explained in greater detail below, in some method aspects of the present invention, a user may grab and pull outward on exposed portions 1801, as demonstrated by example force and/or motion arrows 1803, and cause hair tie 1800 to tighten inward, closing a central hair-gripping void 1805 around her or his hair. In some embodiments, such a central hair-gripping void is, or approximately is, two (2) inches in diameter. However, in some embodiments, such a central hair-gripping void is provided in different sizes, to accommodate different users, as discussed in greater detail below.

Before discussing such aspects further, it should be noted that a wide variety of materials will be suitable for the present invention, including, but not limited to, the following: In some embodiments, fabric 1802 may include silk. In some such embodiments, fabric 1802 includes a washable silk. In some such embodiments, fabric 1302 includes silk charmeuse (e.g., 100% silk charmeuse). In some such embodiments, fabric 1802 includes silk Georgette. In some such embodiments, fabric 1802 includes silk Crepe de Chine (CDC). In some such embodiments, fabric 1802 includes silk Chiffon. In some embodiments, fabric 1802 includes another type of smooth, soft material. In some embodiments, fabric 1802 includes a textured material. In some embodiments, fabric 1802 includes a material similar to silk. In some embodiments, fabric 1802 includes satin. In some such embodiments, fabric 1802 includes cotton. In some embodiments, fabric 1802 includes polyester. In some such embodiments, fabric 1802 includes modal. In some embodiments, fabric 1802 includes velvet. In some embodiments, fabric 1802 includes Linen. In some embodiments, fabric 1802 includes natural sweater knit yarns. For example, some such knit yarns include Alpaca. As another example, some such knit yarns include wool. As another example, some such knit yarns include cashmere. As another example, some such knit yarns include Yak. As another example, some such knit yarns include silk.

In some embodiments, the band or cord within hair tie 1800 includes an elastic material (e.g., a soft elastic). In some embodiments, the band or cord within hair tie 1800 includes a non-elastic material. In some embodiments, the band or cord within hair tie 1800 includes only non-elastic materials. In some embodiments, the band or cord within hair tie 1800 includes only elastic materials. Where elastic materials are used, in some embodiments, those materials may vary in shape. For example, in some embodiments, a flat elastic material is used. As another example, in some embodiments, a round and/or tubular elastic may be used. Also where elastic materials are used for such a band or cord, in some embodiments, those materials may vary in texture. For example, in some embodiments, a smooth texture may be used. As another example, in some embodiments, a grosgrain texture may be used. As another example, in some embodiments, a braided texture may be used. As another example, in some embodiments, a knitted texture may be used. As another example, in some embodiments, a woven texture may be used. Also where elastic materials are used for such a band or cord, in some embodiments, those materials may vary in content. For example, in some embodiments, such materials may include cotton. As another example, in some embodiments, such materials may include polyester. As another example, in some embodiments, such materials may include rubber. In some embodiments, the band or cord within hair tie 1800 is adjustable. For example, in some such embodiments, the band or cord within hair tie 1800 is adjustable in length. As another example, in some such embodiments, the band or cord within hair tie 1800 is adjustable in tightness. As yet another example, in some embodiments, the band or cord within hair tie 1800 is adjustable in size. As yet another example, in some embodiments, the band or cord within hair tie 1800 is adjustable in holding force. As yet another example, in some embodiments, the band or cord within hair tie 1800 is adjustable in any combination of any or all of length, tightness, size and/or holding force. In some embodiments, the band or cord within hair tie 1800 is adjustable by pulling on either (or, preferably, both) of two exposed portions 1801, which are part of, or connected with, the generally circular band or cord (not fully pictured), generally surrounded by a fabric 1802. In some embodiments, fewer or more than two of such exposed portions 1801 may be included. For example, in some embodiments one such exposed portion is included. In some embodiments, three or more such exposed portions are included. In some embodiments, the band or cord within hair tie 1800 may be held within a stitched, circumferential channel (not pictured) of fabric 1802. In some such embodiments, such a stitched channel is one-half (½) inch in width.

In any event, regardless of the exact combination of constituent materials and adjustability, according to some method aspects of the present invention, a user may control the placement of her or his hair using hair tie 1800, in accordance with any or all of the following steps, in any suitable order, number, or other complete or partial combination thereof:

First, a user may ensure that hair tie 1800 is in an open state, meaning that the generally circular band or cord (not fully pictured), generally surrounded by a fabric 1802 is adjusted to a maximum size and/or length, and/or a minimum tightness and/or holding force, as discussed above. As a result, the central void 1805 of hair tie 1800 is in a generally enlarged state, best for accommodating hair being threaded through it. For example, hair tie 1800 is shown in such an open state in FIG. 18. Following that, a user may grab and collect the shafts of her or his hair in both hands, forming a ponytail or other similar form. Next, a user may thread the ends of the collected shafts of hair through the enlarged central void 1805. Next, a user may pull on each of exposed portions 1801 of the looped or generally circular band or cord within it, drawing more of that circular band or cord outside of surrounding fabric 1802, through cinching passages 1807 (e.g., stitched buttonholes). As will be explained in greater detail below, as a result, hair tie 1800 will enter a tightened, compressed state, closing central void 1805 onto it. Finally, in some embodiments, the looped or generally circular band or cord within hair tie 1800 may lock or "cinch," in place, holding the tension from that tightened, compressed state, as will be shown in reference to additional figures, below. In some embodiments, a user may so tighten or compress hair tie 1800 to any desired degree, by drawing out more or less of the generally circular band or cord within it, and locking or cinching it in place. In some embodiments, follows any or all of the steps above to collect and hold her or his hair in place, and prevent her or his hair from spreading out or touching undesired locations (e.g., her skin, where oils may otherwise be transferred, leading to blemishes or oily hair).

In some embodiments, the size of the materials used in hair tie 1800, and/or the circumference of it, and its central hair-gripping void 1805 may be provided in a size appropriate for holding and controlling different thicknesses and/or volumes of hair, of particular users and uses. For example, in some embodiments, a user with finer hair may be provided with such a hair tie with a smaller size of materials, and/or a smaller central hair-gripping void. As another example, in some embodiments, a user with thicker hair (e.g., thicker individual hair shafts, and/or a higher hair count) may be provided with such a hair tie with a larger size of materials, and a larger central hair-gripping void.

Figure 19:
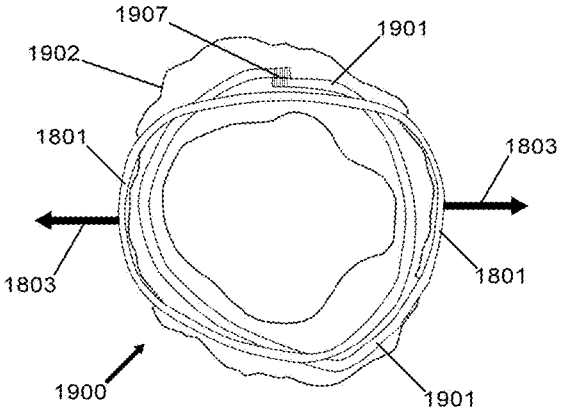
FIG. 19 is a side, cross-sectional view of an example new form of hair tie, in accordance with some embodiments of the present invention.

FIG. 19 is a side, cross-sectional view of an example new form of hair tie 1900, in accordance with some embodiments of the present invention. From this cross-sectional view, an example form of looped band or cord 1901 within a surrounding fabric 1902 can be seen. As pictured, looped band or cord 1901 is formed as a single, continuous cord or band of material, which is double-looped. As a result, when a user pulls outwardly on exposed portions 1801 of looped band or cord 1901, as demonstrated by example force and/or motion arrows 1803, the double-loop tightens inward, as will be discussed in greater detail below. In some scrunchie manufacturing embodiments, the looped band or cord 1901 may initially be a single, unlooped band or cord, which is threaded through openings, such as either of cinching passages 1807, in surrounding fabric 1902 to form loops internally, and then be joined together in such a looped configuration (e.g., via a weld or other joinery such as example end stitching 1907.)

Figure 20:
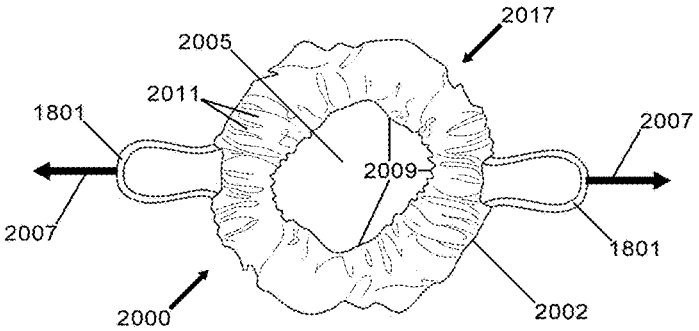
FIG. 20 is a side view of an example new form of hair tie, in a tightened state, in accordance with some embodiments of the present invention.

FIG. 20 is a side view of an example new form of hair tie 2000, in a tightened state 2017, in accordance with some embodiments of the present invention. As explained above, because a user has pulled outwardly on exposed portions 1801 of a looped band or cord held within a surrounding fabric 2002 of hair tie 2000, that looped band or cord has become smaller, tightening inward. As a result, a smaller, tightened central void 2005 has resulted. If, as discussed above, a user first threads her or his hair through central void 2005, while so pulling on exposed portions 1801 (as shown by example outward motion arrows 2007) her or his hair may be collected and held together in a pony tail, or similarly controlled, bound configuration.

In some embodiments, central void 2005 has a flattened circumference, due to formation techniques encouraging the formation of flat surfaces on the inward-facing outer area 2009 of surrounding fabric 2002. For example, in some embodiments, the looped band or cord is held within a channel (e.g., a sewn channel) matching the size and shape of the band or cord (meaning that it is slightly larger, but a similar shape, and able to hold it in a fixed rotational position—e.g., if a flat band or cord is used). In such embodiments where a looped band or cord with a flattened length are used, this also encourages the formation of flat surfaces on the inward-facing outer area 2009. In addition, in some embodiments, pre-determined folds or pleats, such as the examples pictured as example folds 2011, may be included, also encouraging the formation of flat surfaces on the inward-facing outer area 2009. When combined with a soft, smooth surrounding fabric 2002, with limited chemical reactivity, such as silk, a user's hair is kept smooth and kink-free, during sleep, while holding and controlling it.

In some embodiments, the exposed portions 1801 may be wrapped around the fabric 1802, or otherwise locked into an outwardly pulled position (e.g., as in a cinch). For example, in some embodiments, exposed portions 1801 may have a thickness causing them to serve as a "stopper," and hold in place against cinching passages 1807, after being so outwardly pulled. In some embodiments, an exterior texture also aids in such holding in place, providing friction against cinching passages 1807. For example, in some embodiments, grip-enhancing sub-elements, such as any of the grip-enhancing sub-elements discussed above, may line the outer surface of exposed portions 1801, as such an exterior texture. In some embodiments, the exposed portions 1801 may be tucked under, or otherwise stowed, in or under fabric 1802, or in a hiding place or structure within or about fabric 1802. In some embodiments, exposed portions 1801 may be wrapped and/or tied together—e.g., for aesthetic reasons.

Figure 21:
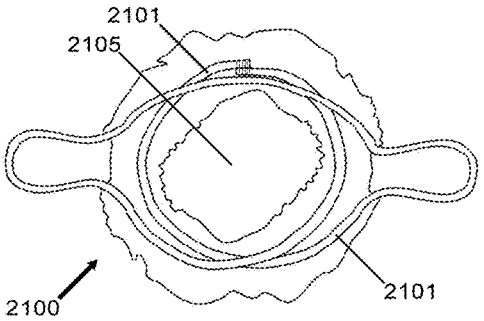
FIG. 21 is a side, cross-sectional view of an example new form of hair tie, in a tightened state, in accordance with some embodiments of the present invention.

FIG. 21 is a side, cross-sectional view of an example new form of hair tie 2100, in a tightened state, in accordance with some embodiments of the present invention. As with the cross-sectional view shown above, in reference to FIG. 19, a looped band or cord 2101 is formed as a single, continuous cord or band of material, which is double-looped. As a result, because a user has pulled outwardly on exposed portions 1801 of looped band or cord 2101, as demonstrated by example force and/or motion arrows 1803, the double-loop has tightened inward, forming a smaller, tightened central void 2105, in accordance with the techniques set forth above.

Although the example of a generally toroid shape for hair ties 1800, 1900, 2000 and 2100 have been provided, it should be understood that a wide variety of alternative shapes and sizes of such hair ties, or any component thereof (e.g., fabric 1802) may also, or alternatively, be used, in various embodiments of the invention. For example, in some embodiments, at least one side of the hair tie fabric may form a pouch, for receiving, holding and hiding the end or bob of a user's hair, while retaining a cinching function of the hair tie, described above.

As mentioned above, a wide variety of alternative embodiments of the present invention will be apparent to those of skill in the art(s) relevant to the invention. For example, any aspect of the invention set forth above may be combined with any other aspect, in different numbers, combinations, orders and configurations, in various innumerable embodiments. Any such embodiments, among others, fall within the scope of the invention, and the recitation of any particular embodiments is for illustrative purposes, and does not limit the scope of the invention.

We claim:

1. A garment fastening system, comprising:

a garment, comprising a band, comprising a first material, configured to at least partially encircle and hold at least part of a human user's body;

a plurality of grip-enhancing sub-elements, comprising a second material, located on or about an inward-facing side of said band, wherein said plurality of grip-enhancing sub-elements are separately attached to, and separated from each other by, said band;

wherein said grip-enhancing sub-elements are arranged in a pattern on or about said band;

wherein a plurality of said plurality of grip-enhancing sub-elements are located at least partially within a channel at least partially formed within a third material of said garment.

2. The garment fastening system of claim 1, wherein said pattern comprises repeated sub-pattern elements of said grip-enhancing sub-elements.

3. The garment fastening system of claim 2, wherein said repeated sub-pattern elements of said grip-enhancing sub-elements are uniformly spaced from one another.

4. The garment fastening system of claim 2, wherein said repeated sub-pattern elements of said grip-enhancing sub-elements are non-uniformly spaced from one another.

5. The garment fastening system of claim 1, wherein said grip-enhancing sub-elements are uniformly spaced from one another.

6. The garment fastening system of claim 1, wherein said grip-enhancing sub-elements are non-uniformly spaced from one another.

7. The garment fastening system of claim 1, wherein said grip-enhancing sub-elements are attached to a backer material, comprised in said band.

8. The garment fastening system of claim 7, wherein said backer material comprises an elastic material.

9. The garment fastening system of claim 1, wherein said band is comprised in a waistband of said garment.

10. The garment fastening system of claim 1, wherein said garment is a bottom garment.

11. The garment fastening system of claim 10, wherein said bottom garment is a pair of pants.

12. The garment fastening system of claim 10, wherein said bottom garment is a pair of shorts.

13. The garment fastening system of claim 10, wherein said bottom garment is a pair of tights or leggings.

14. The garment fastening system of claim 10, wherein said bottom garment is underwear.

15. The garment fastening system of claim 1, wherein said plurality of grip-enhancing sub-elements are fewer per unit of area at an edge of said band than at a location other than said edge, on the surface of said band.

16. The garment fastening system of claim 15, wherein said plurality of grip-enhancing sub-elements are arranged in a V-shaped pattern, and are configured to enhance the positioning of said garment on a user's body.

17. The garment fastening system of claim 1, wherein said plurality of grip-enhancing sub-elements extend onto an interior surface of said garment below said band.

18. The garment fastening system of claim 17, wherein said pattern comprises a gradient, wherein said plurality of grip-enhancing sub-elements decrease in frequency per unit of area of said interior surface of said garment in at least one direction.

* * * * *